US007214119B2

(12) United States Patent
Lucas et al.

(10) Patent No.: US 7,214,119 B2
(45) Date of Patent: May 8, 2007

(54) INFLATABLE REMOTE CONTROL VEHICLE

(75) Inventors: Jeffrey T. Lucas, Southlake, TX (US); Eric McClure, Trabuco Canyon, CA (US)

(73) Assignee: Isotech, Inc., Garden Grove, CA (US)

( * ) Notice: Subject to any disclaimer, the term of this patent is extended or adjusted under 35 U.S.C. 154(b) by 0 days.

(21) Appl. No.: 10/857,327

(22) Filed: May 28, 2004

(65) Prior Publication Data

US 2005/0287920 A1 Dec. 29, 2005

(51) Int. Cl.
*A63H 17/00* (2006.01)

(52) U.S. Cl. ..... 446/465; 446/220; 446/456; 446/470

(58) Field of Classification Search ..... 446/220–226, 446/454, 456, 465, 470
See application file for complete search history.

(56) References Cited

U.S. PATENT DOCUMENTS 4,208,834 A * 6/1980 Lin ..... 446/226
5,195,920 A * 3/1993 Collier ..... 446/409
5,232,390 A * 8/1993 Brooks ..... 446/268
5,512,002 A * 4/1996 Lieberman ..... 446/221
6,659,837 B1 * 12/2003 Lieberman ..... 446/220

FOREIGN PATENT DOCUMENTS

DE 20300739 U1 * 5/2003

* cited by examiner

*Primary Examiner*—John A. Ricci
(74) *Attorney, Agent, or Firm*—Paul, Hastings, Janofsky & Walker LLP

(57) ABSTRACT

An inflatable remote control vehicle having a wheel-less inflatable vehicle body attached to a remotely controlled base unit and fully functional chassis having a plurality of visually functional wheels. The inflatable vehicle body includes a plurality of wheel well areas for accommodating the functional wheels of the base unit and allowing the functionality of wheels to be seen by a viewer. The remote control vehicle preferably includes a rigid support structure connected to a bottom surface of the inflatable vehicle body, where the rigid support structure is then attached to the remotely controlled base unit.

20 Claims, 7 Drawing Sheets

INFLATABLE REMOTE CONTROL VEHICLE

BACKGROUND OF THE INVENTION

1. Technical Field

The subject invention relates generally to the field of toy vehicles, and, more particularly, to an inflatable remote control toy vehicle.

2. Description of Related Art

Conventional remote control toy vehicles have typically been formed from hard plastic molded materials. There are difficulties associated with forming such remote control vehicles out of a hard plastic material. For instance, the hard plastic bodies of conventional remote control toy vehicles are breakable and can crack upon impact with a hard surface. Once the hard plastic bodies of the toy vehicles become cracked, the performance of the toy vehicle can be impacted and even render the toy vehicle unusable.

There have been attempts to provide remote control vehicles that are not constructed out of a hard plastic material. For example, U.S. Pat. No. 6,659,837 issued to Lieberman discloses an inflatable radio control car having an inflatable body with a cavity formed in its bottom surface that is situated over a remotely controlled drive unit. The inflatable radio control car of U.S. Pat. No. 6,659,837 is designed to be used as a promotional display, such that it possesses non-functional, inflatable wheels formed as part of the inflatable body that are intended to provide an overall appearance simulating the appearance of a real car. The remotely controlled drive unit is hidden underneath the inflatable body and allows the promotional display to be moved around. While the toy car disclosed in U.S. Pat. No. 6,659,837 avoids some of the problems associated with hard plastic remote control vehicles, it possesses a number of other deficiencies that limit its effectiveness as being utilized as a remote control toy vehicle as opposed to merely an promotional display. Initially, by positioning the inflatable wheels of the inflatable body very close to the ground such that they assume the appearance of real wheels, the functionality of the toy car in U.S. Pat. No. 6,659,837 is limited as it has a very low clearance and must be used on a flat, level surfaces to keep the inflatable wheels from engaging the ground surface. Moreover, the inflatable front and rear wheels of the inflatable body do not move or rotate, thus rendering a rather unrealistic effect of making the toy car in U.S. Pat. No. 6,659,837 seem to float or hover when the drive unit moving the object cannot be seen by a viewer. Still further, the remotely controlled drive unit is located in a rectangular housing positioned in the center of the device, thus limiting the functionality and performance of the toy car in the '837 patent by having the movement and steering of the device limited to very center of the device in attempting to hide the drive unit from sight.

SUMMARY

The following is a summary of various aspects and advantages realizable according to various embodiments of the inflatable remote control vehicle according to the present invention. It is provided as an introduction to assist those skilled in the art to more rapidly assimilate the detailed discussion of the invention that ensues and does not and is not intended in any way to limit the scope of the claims that are appended hereto.

The various embodiments described below relate to an inflatable remote control vehicle having a wheel-less inflatable vehicle body attached to a remotely controlled base unit having a plurality of visually functional wheels. The inflatable vehicle body includes a plurality of wheel well areas for accommodating the functional wheels of the base unit and allowing the functionality of wheels to be seen by a viewer. The remote control vehicle preferably includes a rigid support structure connected to a bottom surface of the inflatable vehicle body, where the rigid support structure is then attached to the remotely controlled base unit.

By utilizing an inflatable vehicle body, a much more durable remote control vehicle can be produced in accordance with the present invention than previously attainable with breakable hard plastic frame bodies. The performance and functionality of the remote control vehicle is enhanced by lightweight nature of the inflatable vehicle body. The inflatable vehicle body of the remote control vehicle further allows vehicles having varying dimensions to be produced by simply varying the size of the inflatable vehicle body. Since the inflatable vehicle body is formed without wheels, the inflatable vehicle body does not obscure the visibility of the functionality of the wheels, thereby adding to the realistic effect of the remote control vehicle simulating a real vehicle by allowing a viewer to see the wheels actually turning and driving the vehicle. The remote control vehicle further possesses an increased performance through use of a remote control base unit comprising a fully functional chassis having functional wheels whose function is not inhibited by the wheel-less inflatable body attached to the base unit.

BRIEF DESCRIPTION OF THE DRAWINGS

The features of the present invention, which are believed to be novel, are set forth with particularity in the appended claims. The present invention, both as to its organization and manner of operation, together with further advantages, may best be understood by reference to the following description, taken in connection with the accompanying drawings in which the reference numerals designate like parts throughout the figures thereof and wherein:

DETAILED DESCRIPTION OF THE PREFERRED EMBODIMENTS

The following description is provided to enable any person skilled in the art to make and use the invention and sets forth the best modes contemplated by the inventors of carrying out their invention. Various modifications, however, will remain readily apparent to those skilled in the art, since the general principles of the present invention have been defined herein specifically to provide an inflatable remote control vehicle.

Figure 1A:
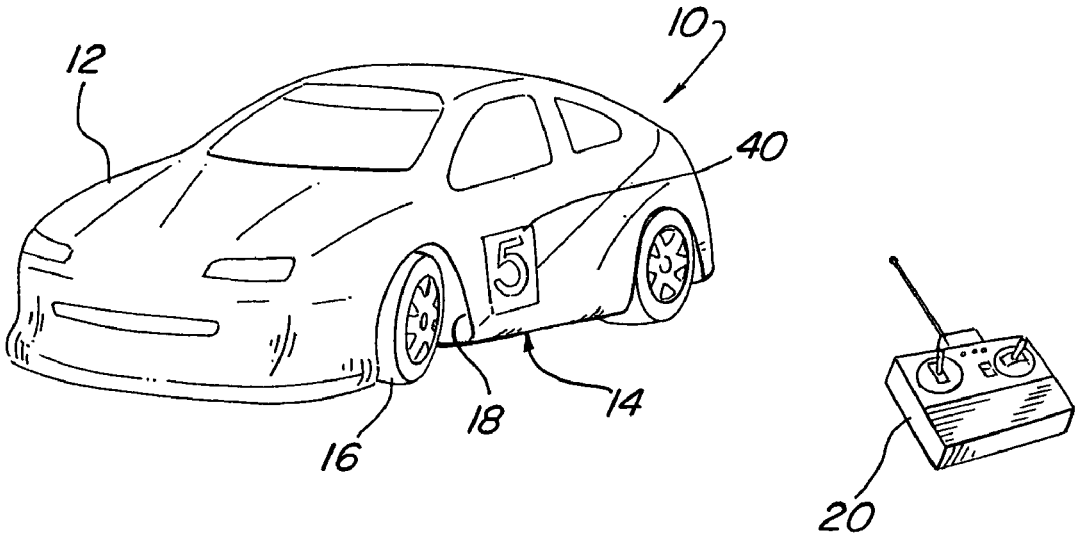
FIGS. 1A and 1B are perspective views of preferred embodiments of the inflatable remote control vehicle.
Figure 1B:
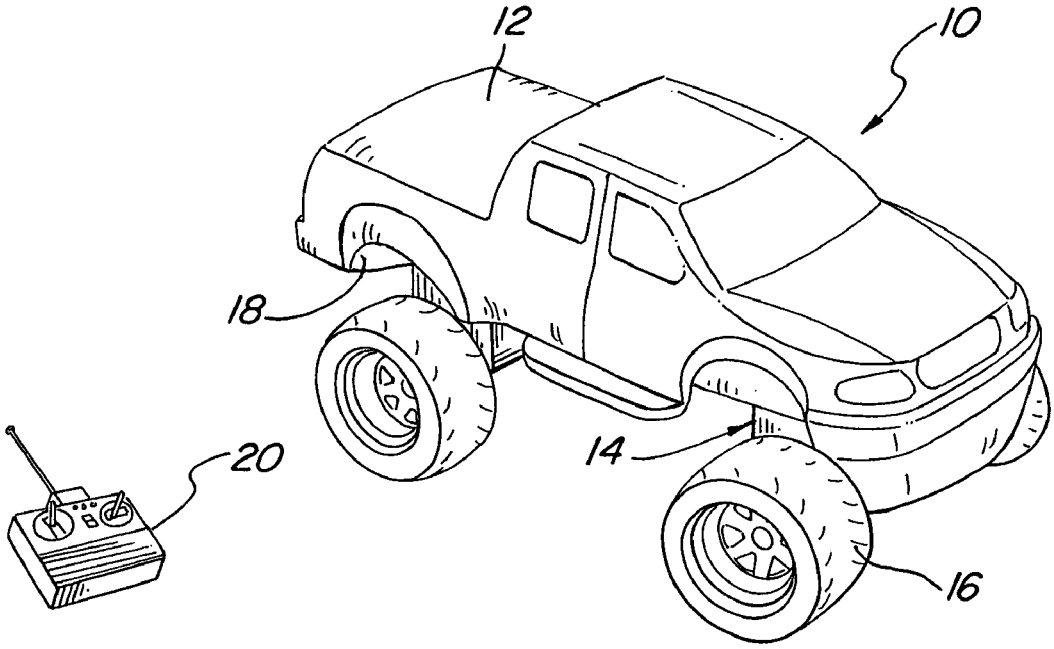

Referring to FIGS. 1A and 1B, a perspective view of two preferred embodiments of a toy inflatable remote control vehicle 10 are illustrated. The remote control vehicle 10 includes an inflatable vehicle body 12 attached to a remotely controlled base unit 14 that includes a plurality of operable and functional wheels 16. The base unit 14 and its functional wheels 16 essentially form the chassis of the remote control vehicle 10. The inflatable vehicle body 12 is formed without wheels and includes a plurality of wheel well areas 18 for accommodating the functional wheels 16 of the base unit 14. The inflatable vehicle body 12 is formed such that, when attached to the base unit 14, the functionality of wheels 16 can be seen by a viewer and the inflatable vehicle body 12 does not hinder their movement or functionality. A viewer could see the wheels 16 rotating to propel the remote control vehicle 10 or turning to steer the remote control vehicle 10.

The remotely controlled base unit 14 includes a receiver for receiving control signals transmitted from of a control unit transmitter 20, such as a hand-held control unit that is conventionally utilized with remote control toy vehicles. The transmitter 20 includes a plurality of operable controls that a user can activate to control the operation of the remote control vehicle 10. The transmitter 20 and its associated receiver in the base unit 14 can be implemented using any transmitter/receiver pair that has conventionally been used with remote control toy vehicles that are well-known to those skilled in the art.

The inflatable vehicle body 12 may be formed to have the appearance of any type of vehicle that the toy remote control vehicle 10 is intended to replicate. For example, the inflatable vehicle body 12 may appear as an automobile, a race car, a truck, a motorcycle, a tank, a snow mobile, or any other type of vehicle. The inflatable vehicle body 12 is also designed to be removably attachable to the base unit 14 such that various designs of the inflatable vehicle body 12 may be interchangeably attached to the base unit 14. In this manner, a single base unit 14 can be provided along with a plurality of different types of inflatable vehicle bodies 12, where a particular design of the inflatable vehicle body 12 can be selected to be attached to the base unit 14 from among the plurality of different types of designs to select the particular type of toy remote control vehicle 10 a user wishes to replicate at any given time. For example, the race car remote control vehicle 10 illustrated in FIG. 1A and the truck remote control vehicle 10 illustrated in FIG. 1B could utilize the same remotely controlled base unit 14 with respective race car and truck designs of the inflatable vehicle bodies 12 being selected to be attachable thereto. In further preferred embodiments of the remote control vehicle 10, the wheels 16 may also be removably interchangeable with other types of wheels or propulsion devices, where a user of the remote control vehicle can select the particular wheels to be attached from a plurality of possible wheel configurations depending upon the particular type of vehicle the toy remote control vehicle 10 is intended to replicate.

The inflatable vehicle body 12 may be formed from any pliable material impermeable to air, such as a flexible plastic sheet material or the like selected from a variety of soft, thin, flexible thermoplastic sheet materials that are substantially air impermeable and preferably thermoplastic, such as polyvinylchlorides, polyolefins and polyesters. The inflatable vehicle body 12 preferably includes a valve (not shown) that allows a user to inflate the inflatable vehicle body 12 with air or other gaseous substance until the inflatable vehicle body 12 forms the shape of its intended design when fully inflated.

The inflatable vehicle body 12 may be attached to the remotely controlled base unit 14 in any manner of attachment known to those skilled in the art. In a preferred embodiment, the remote control vehicle 10 includes a rigid support structure 22 that is adhered to a bottom surface of the inflatable vehicle body 12, where the rigid support structure 22 is then attached to the remotely controlled base unit 14, as illustrated in an exploded, perspective view in FIG. 2A and in an assembled view in FIG. 2B. The rigid support structure 22 provides a solid, stable surface with which the base unit 14 can be reliably attached. The rigid support structure 22 may comprise a single, unitary structure or may comprise a plurality of rigid support structures attached to respective portions of the inflatable vehicle body 12. Thus, the inflatable vehicle body 12 may be designed to have any number of points of attachment to the base unit 14.

Figure 2A:
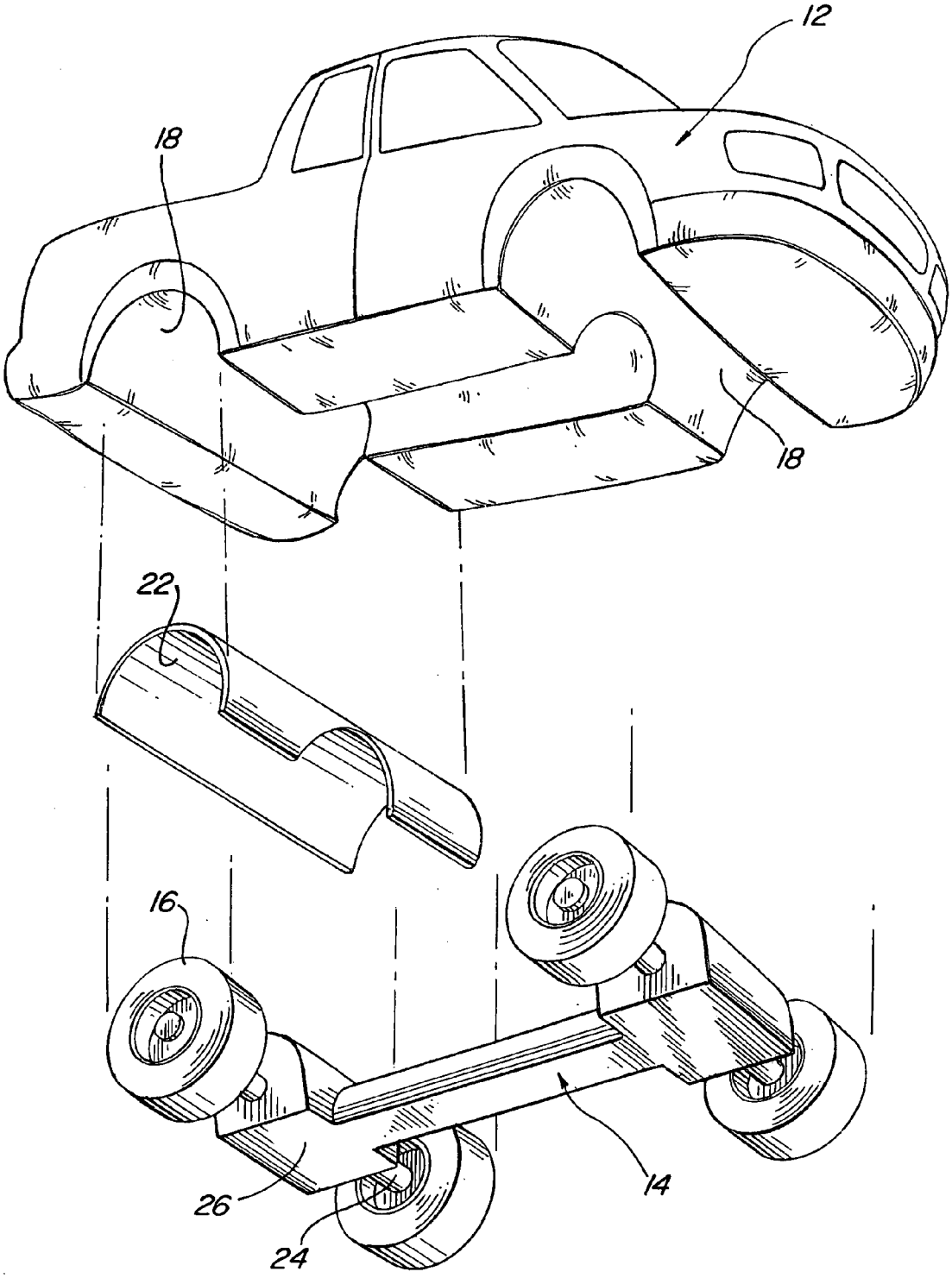
FIG. 2A is an exploded perspective view of a preferred embodiment of the inflatable remote control vehicle.
Figure 2B:
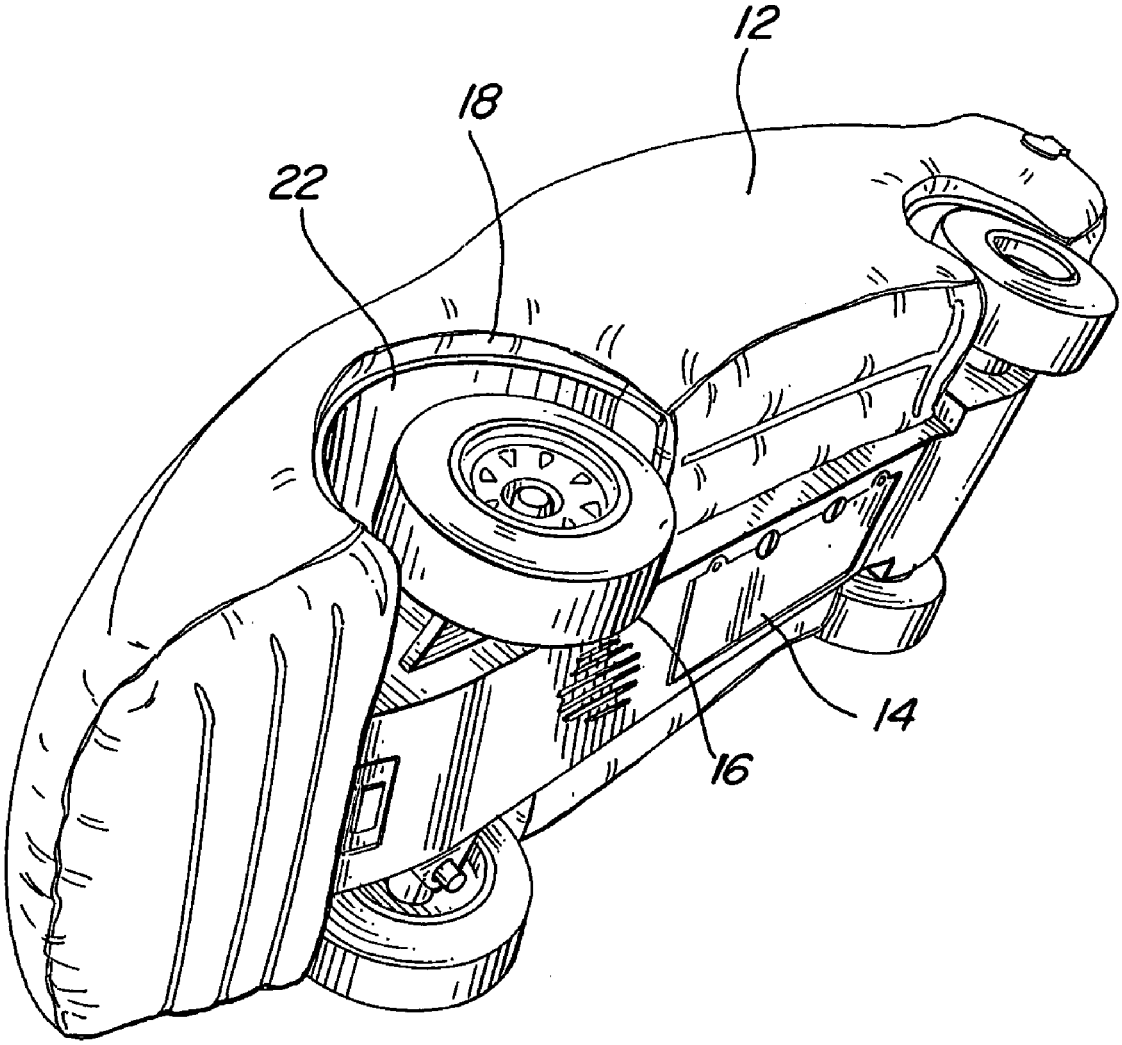
FIG. 2B is a bottom perspective view of a preferred embodiment of the inflatable remote control vehicle.
Figure 3:
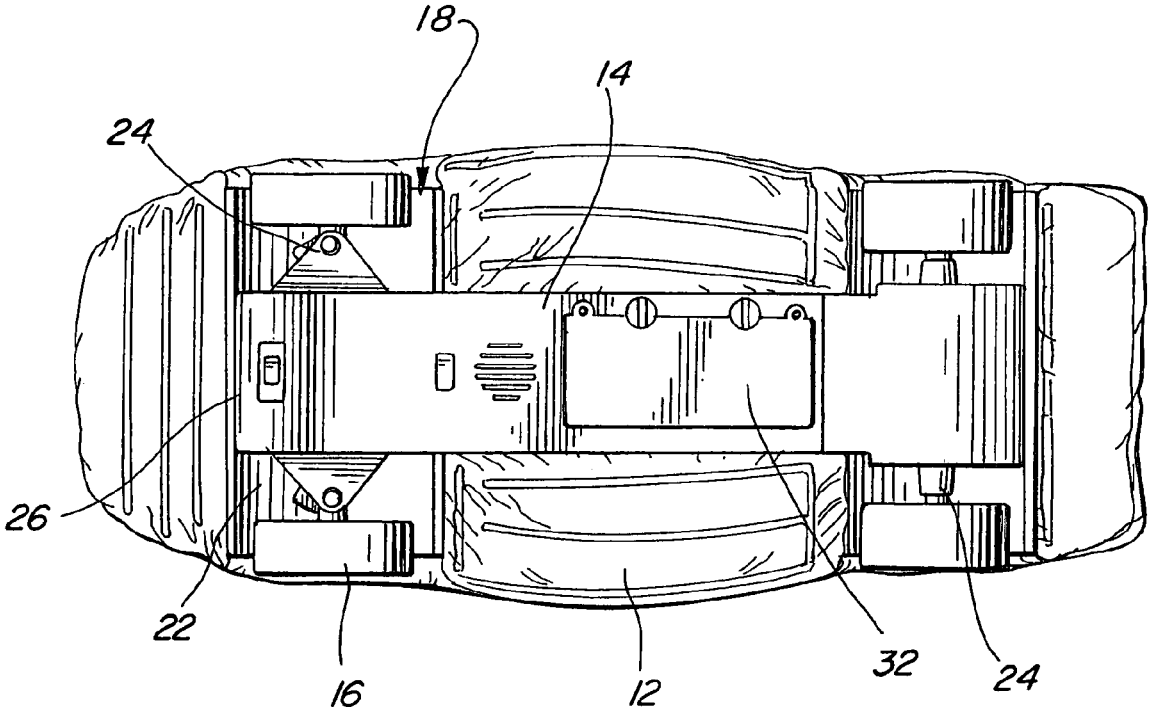
FIG. 3 is a bottom view of a preferred embodiment of the inflatable remote control vehicle.

In one preferred embodiment, a rigid support structure 22 is adhered to at least one of the wheel well areas 18 of the inflatable vehicle body 12, as illustrated in the unassembled state in FIG. 2A and in the assembled state in FIGS. 2B and 3. In this arrangement, the rigid support structure 22 provides a hard surface in the wheel well areas 18 to protect the inflatable vehicle body 12 against damage from contact with the moving wheels 16 or from small objects (e.g., rocks, sticks) that could get kicked up by the moving wheels 16. Furthermore, positioning the rigid support structures 22 in the wheel well areas 18 provides a consistently shaped area for accommodating the wheels 16 to allow them to rotate and turn therein. In order to allow optimal functionality of the wheels 16, the rigid support structures are preferably semi-circular in shape when positioned in the wheel well areas 18 of the inflatable vehicle body 12. Without such rigid support structures 22 positioned in the wheel well areas 18, the inflatable vehicle body 12 could have a tendency to bulge toward the wheels 16 when inflated. Thus, in an alternative embodiment, a least one brace or bar could be positioned in each of the wheel well areas 18 to extend across the wheel well areas 18 and prevent the inflatable vehicle body 12 from bulge toward the wheels 16 when inflated.

Aside from their matingly shaped relationship, the base unit 14 may further be attached to the inflatable vehicle body 12 in any manner of attachment known to those skilled in the art to assist in maintaining their connection when the remote control vehicle 10 is in use. The following manners of attachment are provided merely to illustrate some examples of attachment and the present invention is not intended to be limited to these specific examples. The base unit 14 and the rigid support structures 22, attached to the inflatable vehicle body 12, could be connected through the use of screws, bolts, snaps, adhesive, Velcro®, frictional engagement or other known means.

Figure 4A:
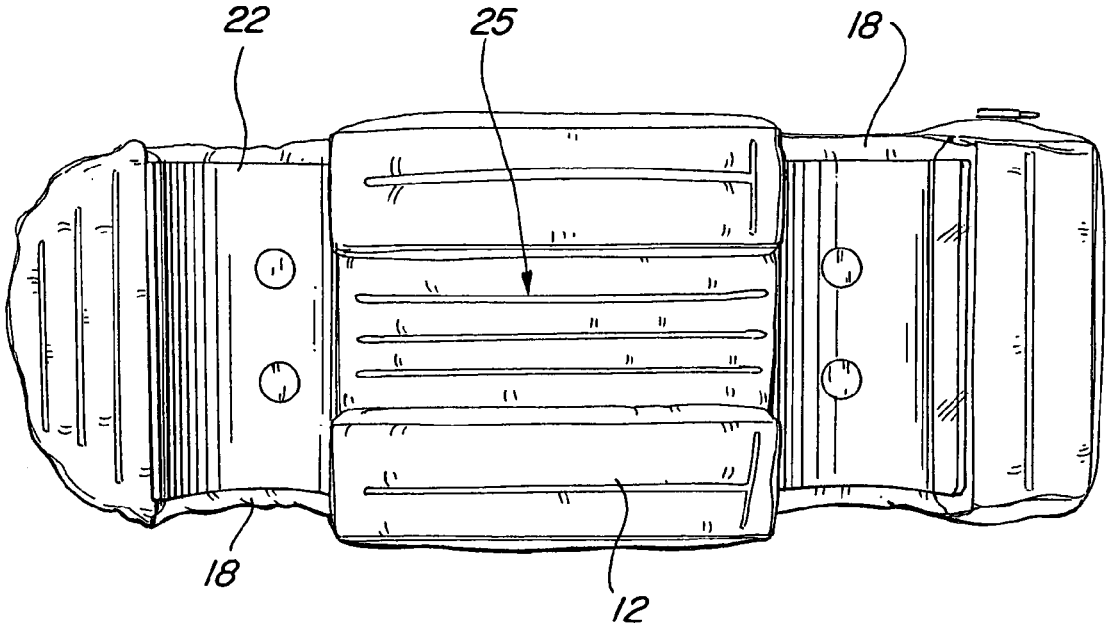
FIG. 4A is a bottom view of a preferred embodiment of an inflatable vehicle body of the inflatable remote control vehicle.
Figure 4B:
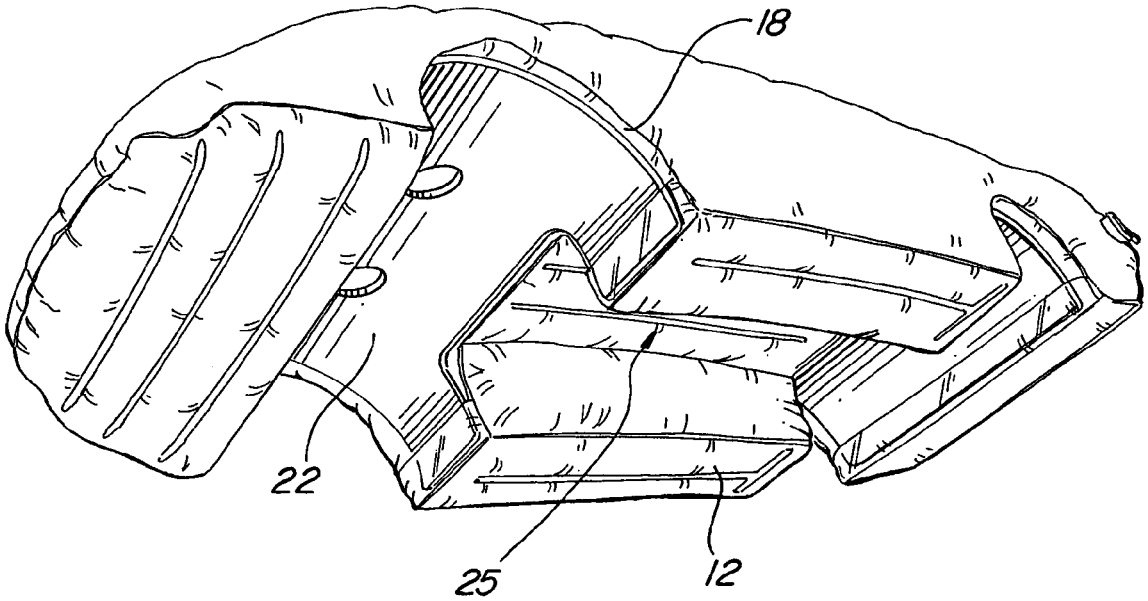
FIG. 4B is a perspective view of a preferred embodiment of an inflatable vehicle body of the inflatable remote control vehicle.

In another preferred embodiment, the inflatable vehicle body 12 may include a central chamber 25 extending between the wheel well areas 18 for accommodating a portion of the base unit 14 that extends between the wheel well areas 18, as illustrated in FIGS. 4A and 4B. This central chamber 25 assists in ensuring that the inflatable vehicle body 12 is properly aligned on the base unit 14. The central chamber 25 further allows the central portion of the inflatable vehicle body 12 to be situated closer to ground, thus further adding to the realistic effect of simulating an actual vehicle.

To further enhance the functionality and performance of the remote control vehicle 10 and to further realistically simulate the performance of an actual vehicle, the base unit 14 in another preferred embodiment may further include axles 24 extending from a drive unit 26 to the wheels 16. The rigid support structures 22 and the wheel well areas 18 should be shaped to accommodate the axles 24 and drive unit 26 in this embodiment. The wheel well area 18 may comprise a cavity in the inflatable vehicle body 12 that extends across a width of the inflatable vehicle body 12, as shown in FIGS. 2A, 2B and 3.

Figure 5A:
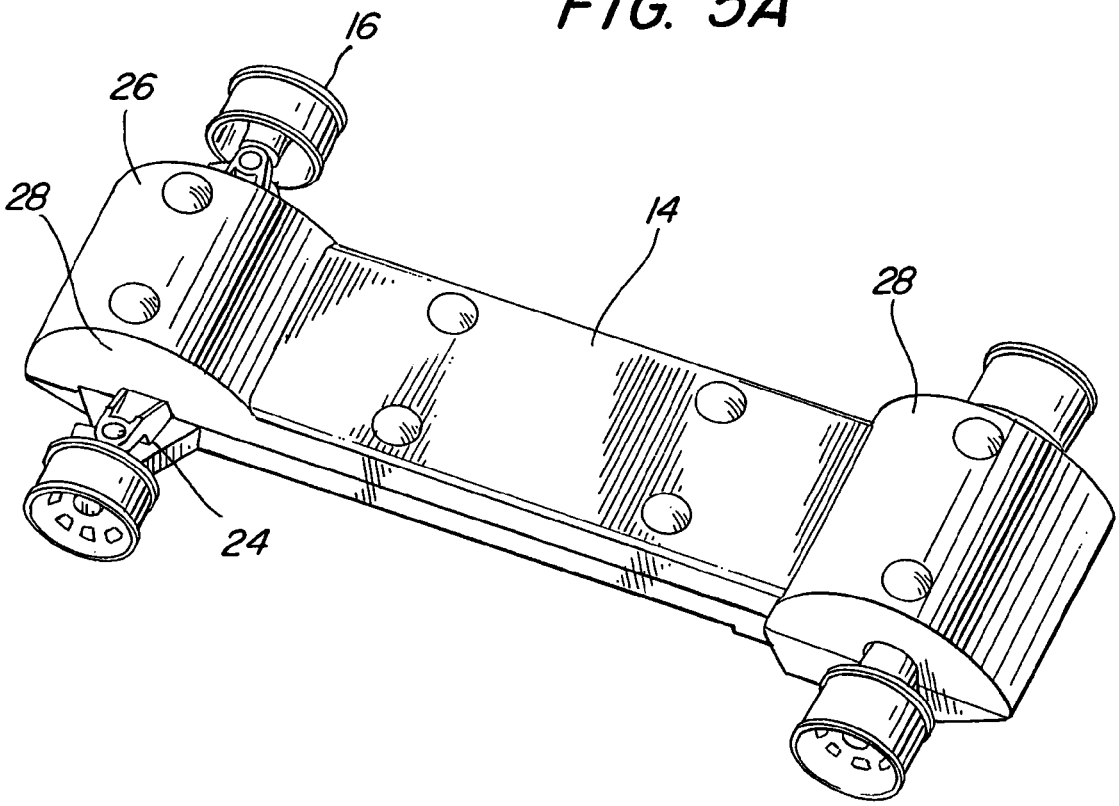
FIG. 5A is a perspective view of a preferred embodiment of a base unit of the inflatable remote control vehicle.
Figure 5B:
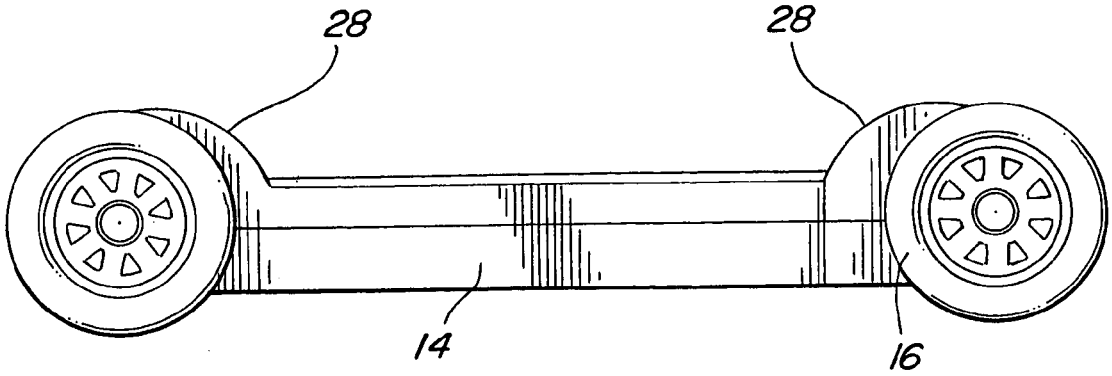
FIG. 5B is a side view of a preferred embodiment of a base unit of the inflatable remote control vehicle.

Referring now to FIGS. 5A and 5B, a perspective view and a side view, respectively, of a preferred embodiment of the remotely controlled base unit 14 are illustrated without the inflatable vehicle body 12 attached thereto. The base unit 14 includes at least one contoured area 28 that is shaped to matingly engage a respective portion of the rigid support structure 22. This provides a simple and efficient manner of consistently aligning and connecting the inflatable vehicle body 12 to the remotely controlled base unit 14. The contoured area 28 of the base unit 14 and the rigid support structure 22 should be similarly shaped such that they matingly engage one another (e.g., male-female connector relationship). In the embodiment where the rigid support structure 22 is formed to be semi-circular, the contoured area 28 of the base unit 14 should similarly be formed in a semi-circular shape. It is the intention of the inventors of the present invention that the contoured area 28 of the base unit and the rigid support structure 22 may be formed to possess any shape and are not limited to semi-circular designs.

Figure 6:
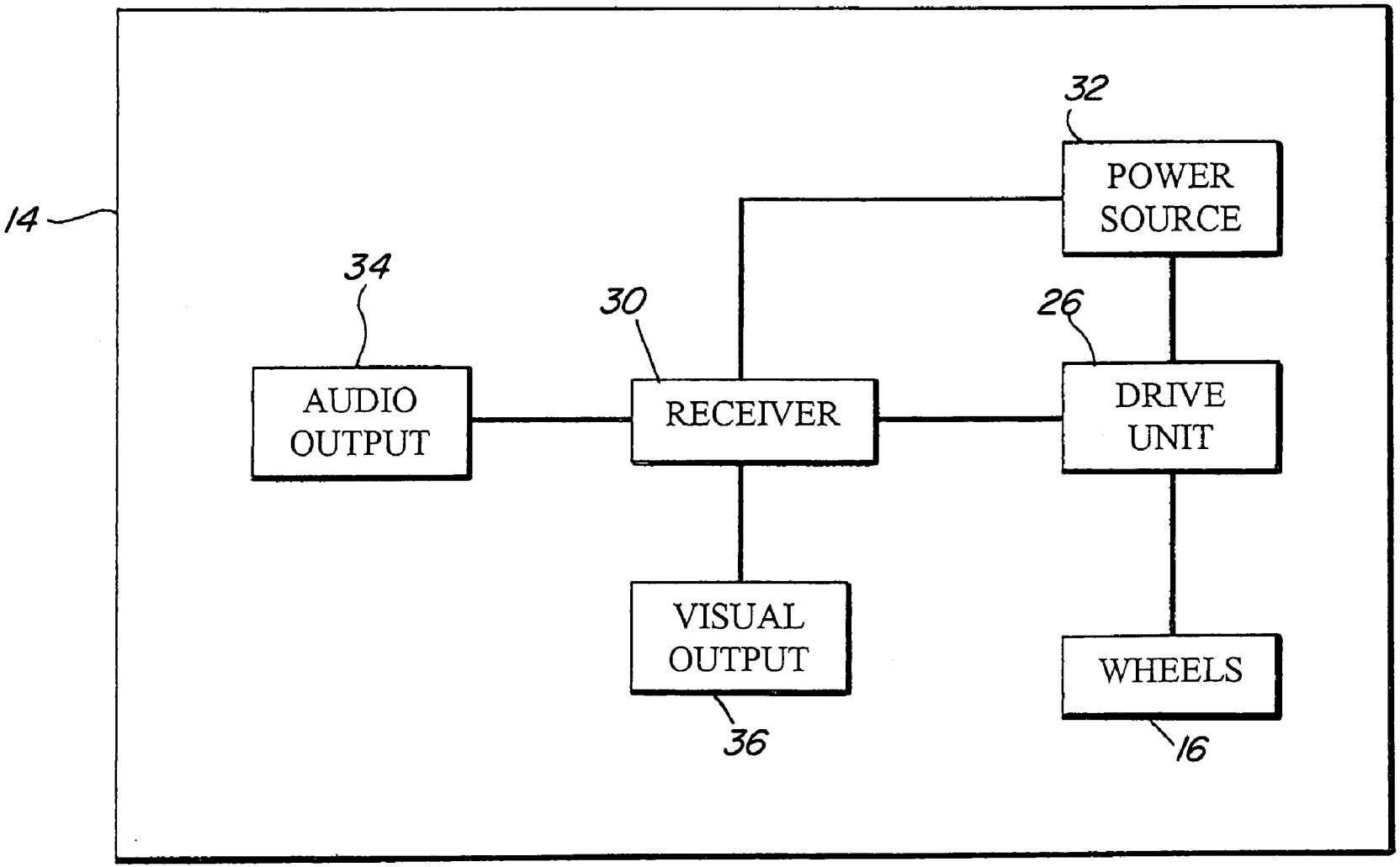
FIG. 6 is a block schematic view of a preferred embodiment of a base unit of the inflatable remote control vehicle.

A block schematic illustration of the components of the remotely controlled base unit 14 is provided in FIG. 6. The block components in FIG. 6 are shown to be connected by a series of lines representing appropriate electrical wiring between the components. The base unit 14 includes a receiver 30 for receiving control signals transmitted from the control unit transmitter 20. The control signals are preferably transmitted at normal radio frequencies, such that the vehicle 10 is a radio control toy vehicle. However, it is the intention of the inventors of the present invention that the control signals are capable of being transmitted by any manner of transmission, at any frequency, or by a wired connection between the base unit 14 and transmitter 20. Further, each individual remote control vehicle 10 may operate at a different frequency or frequency range to allow multiple remote control vehicles 10 to be operated in close proximity to one another without having signal interference between their respective control signals.

The receiver 30 possesses circuitry and logic to receive the control signals and process the control signals such that their desired control functions are transferred to the respective components in the base unit 14. The base unit 14 includes a drive unit 26 for controlling the movement and direction of the remote control vehicle 10 through use of a drive motor connected to the wheels 16 (through axles 24 when applicable), as is conventionally known to those skilled in the art of remote control toy vehicles. The drive unit 26 controls the rotation of the wheels 16 to control the speed and direction of movement of the remote control vehicle 10 and further controls the wheels 16 to control the steering or turning of the remote control vehicle 10. A power source 32, such as an on-board battery, is connected to the drive unit 26 and the receiver 30 and any other components requiring independent power to operate through either direct or indirect wiring connections. The base unit 14 may further include an audio output device 34, such as a horn or a speaker to play prerecorded sounds stored on the base unit 14 or to play voice data transmitted from the control unit transmitter (i.e., walkie-talkie functionality). The base unit 14 may still further include a visual output device 36, such as various lights (e.g., vehicle headlights, taillights), LED displays or other visual displays. Such lights may simulate the functionality of lights on a real vehicle being replicated.

The base unit 14 may comprise the entire chassis of the remote control vehicle 10, as shown in FIGS. 5A and 5B. The base unit 14 may use the control signals to control one, any, or all of the wheels 16 to drive the remote control vehicle 10. In alternative preferred embodiment, the remotely controlled base unit 14 may comprise only a portion of the chassis of the remote control vehicle 10 that is attached to the inflatable vehicle body 12 at any point. For example, the entire base unit 14 could be compactly positioned within one of the wheel well areas 18 such that the base unit 14 only controls the wheels 16 located in the same wheel well area 18 as the base unit 14.

The inflatable vehicle body 12 may be formed to be at least partially transparent, or transparent only in certain regions, such that the visual output device 36 (e.g., lights) can be positioned on the base unit 14 and can be seen through the inflatable vehicle body 12. The inflatable vehicle body 12 may further be configured to possess certain channels extending from the visual output device 36 to an outer surface of the inflatable vehicle body 12 that allow light to be transmitted through the channels to the outside of the inflatable vehicle body 12. For example, these channels can be used to direct light in a certain direction, such as when the visual output device 36 is used as the headlights of the remote control vehicle 10.

In another preferred embodiment, the remote control vehicle 10 may include repair patches 40, as shown in FIG. 1, that can be adhered to the inflatable vehicle body 12 to cover and seal tears or holes which may form in the inflatable vehicle body 12. The patches 40 are large enough to cover the hole and to provide an air-tight seal to prevent the inflatable vehicle body 12 from deflating. The patches 40 may be adhered to the inflatable vehicle body 12 in any manner known to those skilled in the art, such as through use of an adhesive or by heating the patch 40 so that it partially melts and bonds with the inflatable vehicle body 12. The patches 40 may be formed from any suitable material which will remain adhered to the inflatable vehicle body 12, but are preferably formed from the same flexible, plastic material as the inflatable vehicle body 12. The patches 40 may further comprise printed designs or decals so as to enhance the appearance of the inflatable vehicle body 12 (e.g., depicting the number "5" of the race car on a decal, as illustrated in FIG. 1).

By utilizing an inflatable vehicle body 12, a more durable remote control vehicle 10 having an improved performance can be produced than previously attainable with hard plastic frame bodies. The performance, functionality and durability of the remote control vehicle 10 is enhanced by its wheel-less inflatable body 12. The lightweight inflatable vehicle body 12 of the remote control vehicle 10 further allows vehicles having much larger dimensions to be produced. Further, when not in use, the inflatable vehicle body 12 can simply be deflated to allow for compact storage of the remote control vehicle 10. The inflatable vehicle body 12 is further formed to be wheel-less so as to not obscure the visibility of the functionality of the wheels 16, thereby adding to the realistic simulation of a real vehicle achieved by the remote control vehicle 10. Additionally, by utilizing a remotely controlled base unit 14 having a chassis that is very similar to real vehicle chassis with real operating wheels 16 and axles 24, the performance of the remote control vehicle 10 is improved over conventional remote control toy vehicles. The wheel-less inflatable body further does not inhibit the functionality of the wheels of the base unit or of the clearance of remote control vehicle 10, which can be especially important when the remote control vehicle 10 is simulating an off-road vehicle.

The different structures of the inflatable remote control vehicle of the present invention are described separately in each of the above embodiments. However, it is the full intention of the inventors of the present invention that the separate aspects of each embodiment described herein may be combined with the other embodiments described herein. Those skilled in the art will appreciate that various adaptations and modifications of the just described preferred embodiment can be configured without departing from the scope and spirit of the invention. Therefore, it is to be understood that, within the scope of the appended claims, the invention may be practiced other than as specifically described herein.

What is claimed is:

1. An inflatable remote control toy vehicle, comprising:

a remotely controlled base unit having a plurality of visually functional wheels;

a wheelless inflatable vehicle body mounted to said base unit, wherein said inflatable vehicle body is formed to allow movement of said wheels to be viewed during operation of the vehicle, wherein said inflatable vehicle body includes wheel well areas for accommodating said functional wheels therein, further wherein each of said wheel well areas of said inflatable body includes a rigid support structure attached thereto such that said rigid support structure serves as a rigid wheel well for said vehicle;

wherein said inflatable vehicle body is mounted to said base unit by connecting a rigid support structure to said base unit.

2. The inflatable remote control toy vehicle of claim 1, where said base unit further comprises a contoured area that is shaped to matingly engage a respective portion of said rigid support structure.

3. The inflatable remote control toy vehicle of claim 2, wherein said rigid support structure and said contoured area of said base unit are semi-circular in shape.

4. The inflatable remote control toy vehicle of claim 2, wherein said wheel well areas comprise a cavity extending across a width of said inflatable vehicle body.

5. The inflatable remote control toy vehicle of claim 1, wherein said base unit further comprises:

a receiver for receiving control signals transmitted from a control unit transmitter;

a drive unit for driving said wheels of said base unit, wherein said drive unit is connected to said receiver such that said drive unit is controlled by said received control signals; and a power source for providing power to each component of said base unit.

6. The inflatable remote control toy vehicle of claim 5, said base unit further comprising an audio output device for outputting audio sounds, wherein said audio output device is connected to said receiver such that said audio output device is controlled by said received control signals.

7. The inflatable remote control toy vehicle of claim 5, said base unit further comprising a visual output device, wherein said visual output device is connected to said receiver such that said visual output device is controlled by said received control signals.

8. The inflatable remote control toy vehicle of claim 7, wherein said inflatable vehicle body is at least partially transparent to allow said visual output device to be visible through said inflatable vehicle body.

9. The inflatable remote control toy vehicle of claim 1, further comprising a repair patch attachable to said inflatable vehicle body to cover holes which develop in said inflatable vehicle body and to provide an air-tight seal with said inflatable vehicle body.

10. The inflatable remote control toy vehicle of claim 1, wherein said wheels are removably attached to said base unit such that said wheels are selected from a plurality of possible wheel configurations.

11. An inflatable remote control toy vehicle, comprising:

a remotely controlled base unit having a plurality of wheels for driving said vehicle;

a wheel-less inflatable vehicle body mounted to said base unit, wherein said inflatable vehicle body includes a plurality of wheel well areas for accommodating said wheels therein; and a rigid support structure attached to said inflatable vehicle body, wherein said inflatable vehicle body is mounted to said base unit by connecting said rigid support structure to said base unit.

12. The inflatable remote control toy vehicle of claim 11, where said base unit further comprises a contoured area that is shaped to matingly engage a respective portion of said rigid support structure.

13. The inflatable remote control toy vehicle of claim 12, wherein said rigid support structure and said contoured area of said base unit are semi-circular in shape.

14. The inflatable remote control toy vehicle of claim 11, wherein said wheel well areas comprise a semi-annular cavity extending across a width of said inflatable vehicle body.

15. The inflatable remote control toy vehicle of claim 11, wherein said base unit further comprises:

a receiver for receiving control signals transmitted from a control unit transmitter;

a drive unit for driving said wheels of said base unit, wherein said drive unit is connected to said receiver such that said drive unit is controlled by said received control signals; and a power source for providing power to each component of said base unit.

16. The inflatable remote control toy vehicle of claim 15, said base unit further comprising an audio output device for outputting audio sounds, wherein said audio output device is connected to said receiver such that said audio output device is controlled by said received control signals.

17. The inflatable remote control toy vehicle of claim 15, said base unit further comprising a visual output device, wherein said visual output device is connected to said receiver such that said visual output device is controlled by said received control signals.

18. The inflatable remote control toy vehicle of claim 17, wherein said inflatable vehicle body is at least partially transparent to allow said visual output device to be visible through said inflatable vehicle body.

19. The inflatable remote control toy vehicle of claim 11, further comprising a repair patch attachable to said inflatable vehicle body to cover holes which develop in said inflatable vehicle body and to provide an air-tight seal with said inflatable vehicle body.

20. The inflatable remote control toy vehicle of claim 11, wherein said wheels are removably attached to said base unit such that said wheels are selected from a plurality of possible wheel configurations.

* * * * *